US009788092B2

(12) United States Patent
Rawls-Meehan et al.

(10) Patent No.: US 9,788,092 B2
(45) Date of Patent: Oct. 10, 2017

(54) SPEAKER SYSTEM

(71) Applicant: ASCION, LLC, Bloomfield Hills, MI (US)

(72) Inventors: Martin B. Rawls-Meehan, Franklin, MI (US); Jacob Michael Lalinsky, Berkley, MI (US); Jeffrey Tu, Bloomfield Hills, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 28 days.

(21) Appl. No.: 14/716,004

(22) Filed: May 19, 2015

(65) Prior Publication Data

US 2015/0334482 A1 Nov. 19, 2015

Related U.S. Application Data

(60) Provisional application No. 62/000,062, filed on May 19, 2014.

(51) Int. Cl.

| | |
|---|---|
| ***H04R 5/02*** | (2006.01) |
| ***H04R 1/02*** | (2006.01) |
| ***H04R 9/06*** | (2006.01) |
| *A47G 9/10* | (2006.01) |
| *A47G 9/00* | (2006.01) |

(52) U.S. Cl.

CPC ..... *H04R 1/028* (2013.01); *H04R 1/025* (2013.01); *H04R 1/026* (2013.01); *H04R 5/02* (2013.01); *A47G 9/1045* (2013.01); *A47G 2009/006* (2013.01); *H04R 2201/025* (2013.01)

(58) Field of Classification Search

CPC . H04R 1/02; H04R 1/025; H04R 5/02; H04R 5/023; H04R 2201/021; H04R 2201/023; H04R 2201/025; H04R 2499/15; H04N 5/642; A47G 9/1045; A47G 2009/006

USPC ..... 381/301, 333, 388, 87, 334, 386, 387; D14/204, 209.1; 181/150, 179, 198, 199; 5/904, 666, 639

See application file for complete search history.

(56) References Cited

U.S. PATENT DOCUMENTS

| | | | | |
|---|---|---|---|---|
| 3,113,633 A | | 12/1963 | Eberhardt | |
| 4,064,376 A | | 12/1977 | Yamada | |
| 4,325,529 A | * | 4/1982 | Seebinger | F16B 2/08 248/218.4 |
| 4,507,816 A | | 4/1985 | Smith, Jr. | |

(Continued)

FOREIGN PATENT DOCUMENTS

| | | | | |
|---|---|---|---|---|
| CN | 202407907 | * | 9/2012 | A47C 3/18 |
| GB | 2439766 A | | 1/2008 | |
| WO | 2013020843 A1 | | 2/2013 | |

*Primary Examiner* — Xu Mei

(74) *Attorney, Agent, or Firm* — Dinsmore & Shohl LLP

(57) ABSTRACT

The present disclosure relates to a piece of furniture, particularly an adjustable bed, having a speaker system. The bed includes a base having an outer peripheral edge. At least one speaker is mounted to the base of the piece of furniture, typically to the legs. The at least one speaker is mounted to face outwards from a center portion of the bed. The at least one speaker is mounted inboard of the outer peripheral edge of the base of the bed so as to conceal the speakers from a top view. The speaker system may also be used with various other pieces of furniture such as couches, chairs, tables, etc. A subwoofer may also be mounted to the base of the bed.

21 Claims, 12 Drawing Sheets

(56) References Cited

U.S. PATENT DOCUMENTS

| | | | | | |
|---|---|---|---|---|---|
| 4,654,728 | A * | 3/1987 | Lunsford | G11B 33/025 | 360/12 |
| 4,657,026 | A * | 4/1987 | Tagg | A61B 5/1102 | 600/534 |
| 4,793,010 | A * | 12/1988 | Gross | A47D 9/04 | 5/105 |
| 5,161,764 | A * | 11/1992 | Roney | A61M 5/1415 | 248/218.4 |
| 5,464,381 | A | 11/1995 | Wilson | | |
| 5,559,893 | A * | 9/1996 | Krokstad | G10K 11/1784 | 381/71.6 |
| 6,024,407 | A | 2/2000 | Eakin | | |
| 6,891,957 | B2 * | 5/2005 | Manrique | H04R 1/026 | 181/153 |
| 6,953,439 | B1 | 10/2005 | Kabemba | | |
| 7,127,075 | B2 | 10/2006 | Park | | |
| 7,587,772 | B2 | 9/2009 | Ward | | |
| 7,594,631 | B1 * | 9/2009 | Carnevali | B60R 11/0241 | 248/219.4 |
| 7,883,065 | B2 * | 2/2011 | Nelson | F16M 11/08 | 248/201 |
| 8,117,699 | B2 | 2/2012 | Richards et al. | | |
| 8,634,572 | B2 | 1/2014 | Davis, Jr. | | |
| 8,675,906 | B2 * | 3/2014 | Lau | H04R 1/02 | 381/386 |
| 8,724,842 | B2 * | 5/2014 | Sumitani | H04R 1/026 | 248/299.1 |
| 2004/0025755 | A1 * | 2/2004 | Maekawa | H04R 1/026 | 108/50.11 |
| 2008/0104750 | A1 * | 5/2008 | Rawls-Meehan | A47C 20/041 | 5/1 |
| 2011/0257904 | A1 | 10/2011 | Deneau | | |

* cited by examiner

SPEAKER SYSTEM

CROSS-REFERENCE TO RELATED APPLICATIONS

This application claims priority benefit to the following U.S. Provisional Application, which is hereby incorporated by reference in its entirety: Application No. 62/000,062, filed May 19, 2014.

FIELD OF THE INVENTION

The present invention is generally related to speaker systems. More particularly, the present invention is related to a speaker system for use with a piece of furniture.

BACKGROUND OF THE INVENTION

It is known in the art to create surround sound systems within the home for personal use. The surround sound systems are typically mounted to walls or on separate stands and connected to an entertainment system. Further, speaker systems are known to have been mounted to headrests, such as in a vehicle, but these systems lack the replication of a surround sound system. Accordingly, there exists a need in the art to provide a speaker system providing a surround sound effect to the user in a bed or utilizing another piece of furniture.

SUMMARY OF THE INVENTION

The present invention relates to a piece of furniture, particularly an adjustable bed, having a speaker system. The bed includes a base having an outer peripheral edge. At least one speaker is mounted to the base of the piece of furniture, typically to the legs. The at least one speaker is mounted to face outwards from a center portion of the bed. The at least one speaker is mounted inboard of the outer peripheral edge of the base of the bed so as to conceal the speakers from a top view. The speaker system may also be used with various other pieces of furniture such as couches, chairs, tables, etc. A subwoofer may also be provided mounted to the base of the bed.

A piece of furniture, particularly an adjustable bed is provided having a modular speaker system. The piece of furniture includes a base defining an outer edge and a plurality of modular speakers mounted to and below the base of the piece of furniture. The plurality of speakers mounted via corresponding mounting by a mounting bracket to face away with respect to each other, the speakers mounted inboard of or up to the outer edge of the base of the piece of furniture. The furniture typically a plurality of legs and wherein the speakers are mounted separately to one of the plurality of legs. The mounting bracket is provided to mount a speaker of the plurality of speakers to a leg of the plurality of legs wherein the bracket is mounted to the plurality of legs by at least one strap. The bracket may include a support feature for anchoring one end of the strap.

The modular speaker system may include a subwoofer mounted to the base of the piece of furniture and/or includes a noise cancellation system having a microphone both adapted to improve sound quality. In most embodiments, the piece of furniture is selected from the group consisting of a bed, an adjustable bed, a couch, a chair, and a table.

In other embodiment, a speaker system operable to mount to a piece of furniture is provided. The speaker system includes at least one speaker adapted to be mounted to a base portion of a piece of furniture, a mounting bracket formed to mount to a leg of the piece of furniture and having at least one mounting feature for supporting the at least one speaker wherein the speaker is mounted to the mounting bracket by way of the at least one mounting feature. The mounting bracket includes at least one fastener adapted to securely mount to the leg below the base and above a floor. The mounting bracket may include at least one mounting strap adapted to wrap around the leg to securely mount the mounting bracket below the base and above a floor. The straps include a plurality of apertures to receive a securing feature formed on the mounting bracket to accommodate and mount to variously shaped and sized furniture legs. The speaker system may also include a subwoofer to optimize sound. In one embodiment, the piece of furniture is an adjustable bed, a power supply integrated with a power supply of the adjustable bed. A wireless device or remote control is operable to control both the adjustable bed and the wireless communication module. The wireless communication module is operable to communicate via Wi-Fi, Bluetooth and the like.

In one embodiment, the speaker mounting assembly includes a three-part assembly including at least one flexible strap. The at least one strap having a free end. A bracket is provided adapted to connect to the flexible strap, the bracket configured to hold a speaker. A connector is mounted to either the bracket or the strap, the connector having a projection configured to secure the free end of the flexible strap when in an assembled position. In one embodiment, the flexible strap, the bracket and the connector are each separate components. The flexible strap may include an aperture adapted to hold and secure the connector.

The flexible strap includes a plurality of apertures and the connector includes a general bulbous distal end adapted to securely connect with one of the plurality of apertures of the flexible strap. The bracket may an aperture configured to secure the strap to the bracket thereby allowing the flexible strap to wrap around a portion of a piece of furniture when in an installed position. The bracket is adapted to securely mount a speaker to the furniture in a universal configuration.

The system creates a surround sound effect and noise masking benefits. The system may also include noise canceling features such as a microphone and noise processing and playback components. Specialty mounts may also be provided to attach and position the speakers to the legs of the bed.

DETAILED DESCRIPTION OF THE INVENTION

Figure 1:
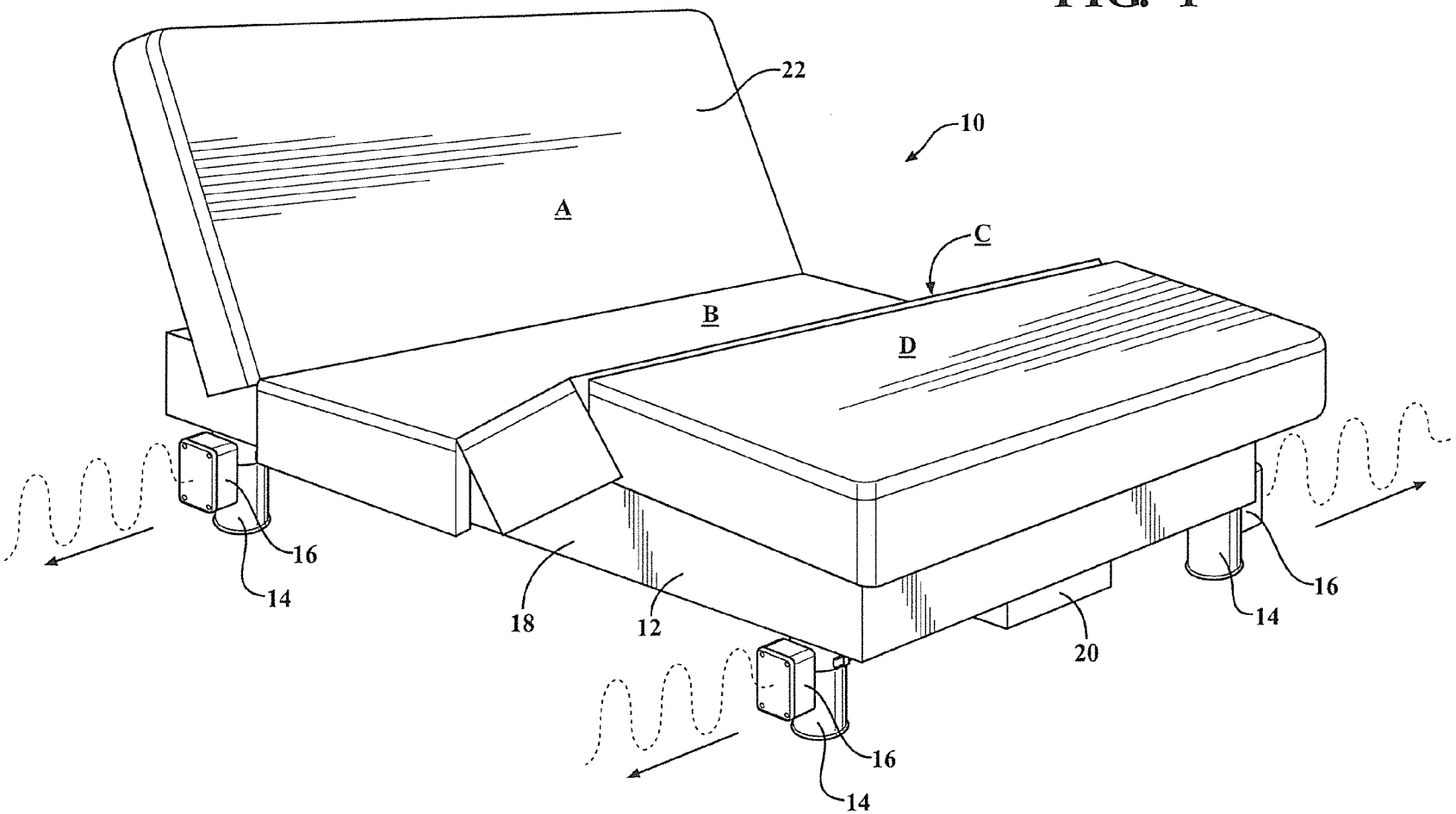
FIG. 1 illustrates a perspective view of a speaker system mounted to an adjustable bed.
Figure 2:
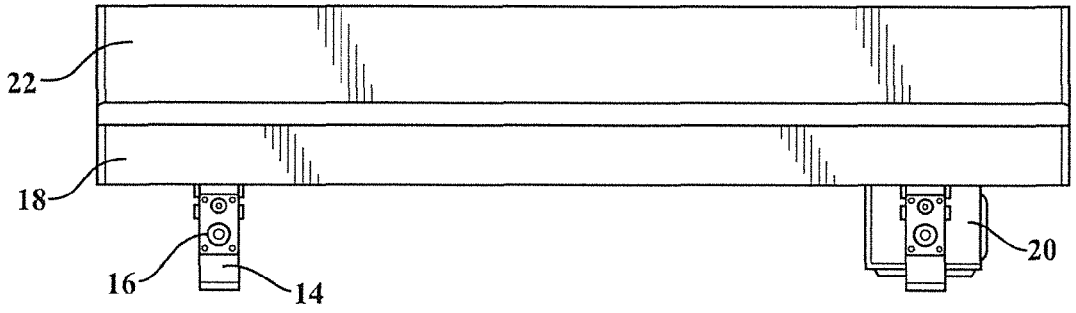
FIG. 2 illustrates a side view of the speaker system of FIG. 1 mounted to an adjustable bed.
Figure 3:
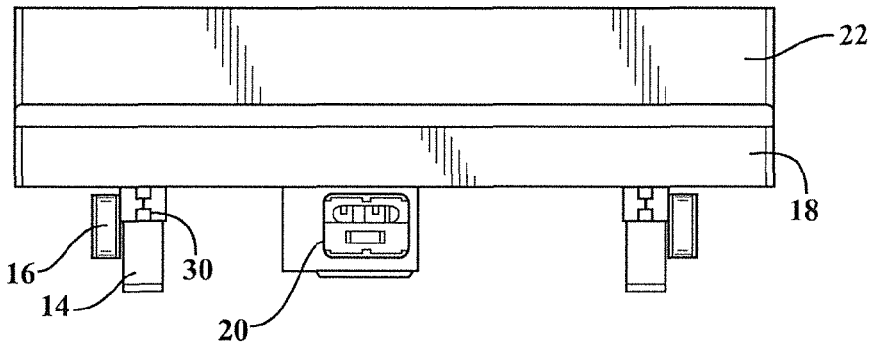
FIG. 3 illustrates a view from the foot of the bed of the speaker system of FIG. 1 mounted to an adjustable bed.
Figure 4:
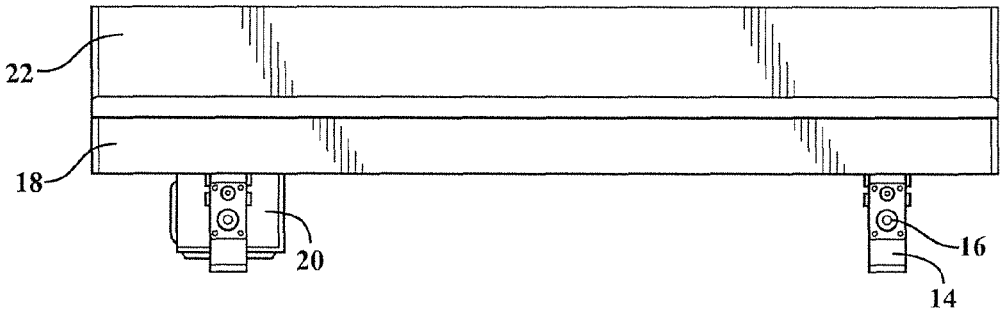
FIG. 4 illustrates an alternative side view of the speaker system of FIG. 1 mounted to an adjustable bed.

The present disclosure relates to a speaker system having at least one speaker mounted to a lower base of a bed, or other piece of furniture, wherein the speaker faces outwardly to create a surround sound effect. In a further embodiment, a plurality of speakers are provided and the speakers face away from each other such that sound paths substantially do not interfere with each other. The speakers are mounted above the floor on which the bed rests. The speakers can be directed outwardly away from a center portion of the bed thereby creating a surround sound effect from the waves bouncing off the walls within the room. In an example, the speakers are mounted to legs of the furniture to be hidden from plain view inset from an outer perimeter of the furniture.

FIGS. 1-6 illustrate one embodiment a speaker system of the present disclosure mounted to an adjustable bed 10. In this example, the adjustable bed 10 includes a base 12 and a plurality of legs 14. Base 12 can also be referred to as a lower deck. In the present embodiment, the legs are generally cylindrical but may also be rectangular, square, or other shapes in various other embodiments.

In one embodiment the plurality of legs 14 are mounted to a lower base 18 of the bed 10. In other embodiments the legs are mounted to a sub base thereby allowing the main base to move with the top deck. This sub base mounts to the side rails. In this embodiment, the base 18 is a platform or side supports for the adjustable bed 10. In other embodiments, the base may be a lower portion of the piece of furniture, cross supports, cushioning, etc.

A subwoofer 20 is provided mounted to the base 18 of the bed 10. In this embodiment, the subwoofer 20 is mounted towards the foot of the bed, which may provide vibration to enhance the surround sound effect of the speaker system. In alternative embodiments, the subwoofer may be mounted towards the head of the bed or to the middle of the bed depending on the preferences of the user.

The adjustable bed 10 further includes a platform portion or adjustable top deck 22 which may form a plurality of seams to define the various sections A, B, C, D (see FIG. 1) when articulated in use. The adjustable bed 10 is typically adjusted by means of a controller and motor driving one or more actuators (not shown).

Figure 5:
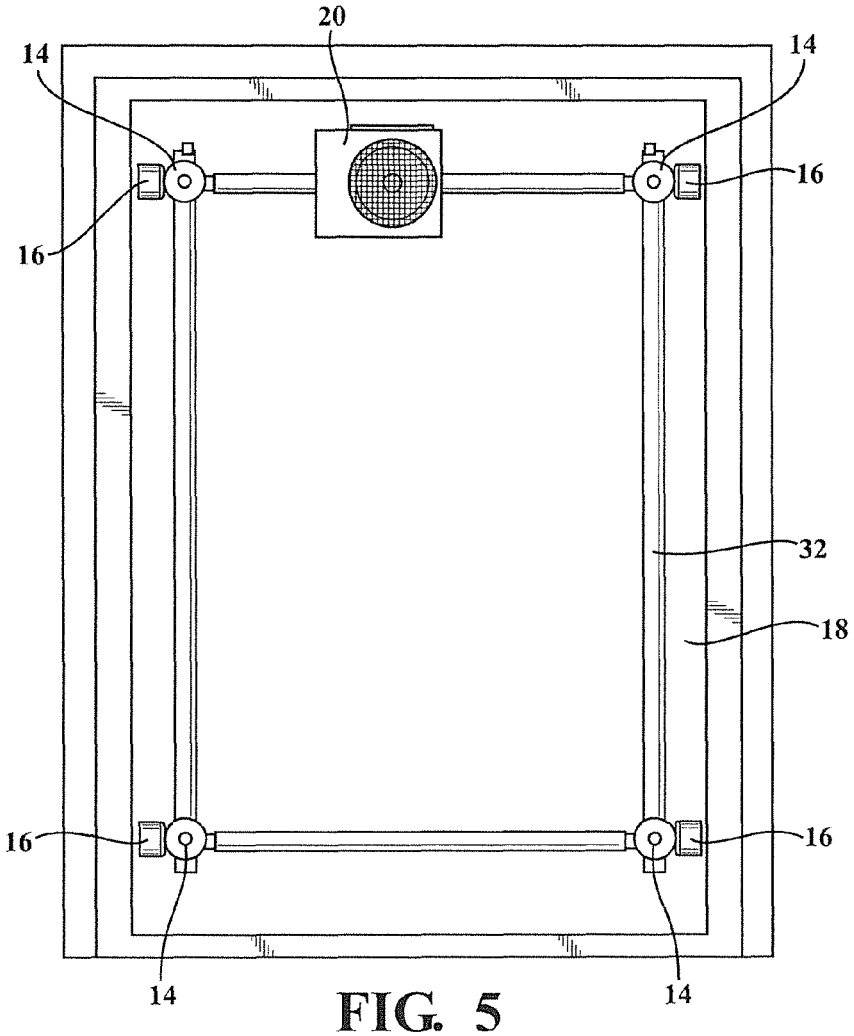
FIG. 5 illustrates a bottom view of the speaker system of FIG. 1 mounted to an adjustable bed.
Figure 6:
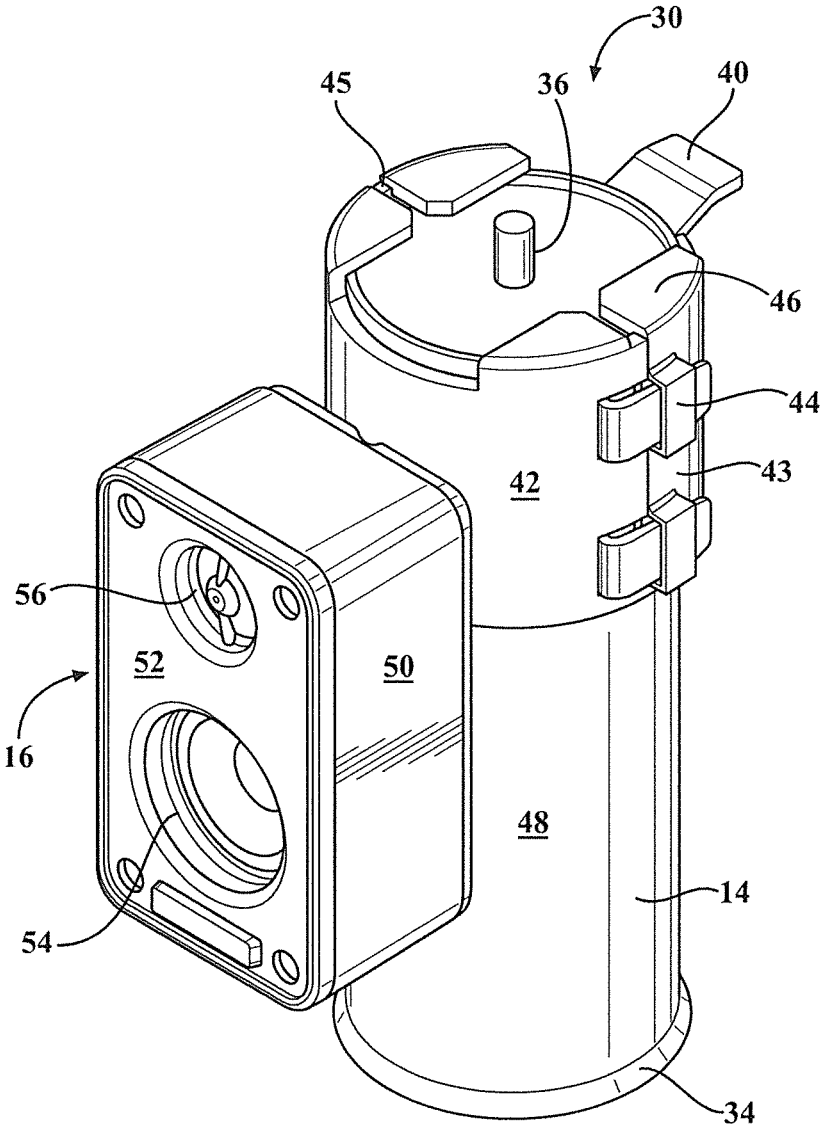
FIG. 6 illustrates an exemplary bracket and speaker mount wherein the speaker is mounted to a leg of an adjustable bed.

As shown in FIG. 5, the speakers 16 can be mounted inboard of an outer peripheral edge 25. The plurality of speakers 16 are positioned to face generally outwardly with respect to a center portion of the bed 10. As the sound waves travel away from the speakers 16, the sound waves can bounce against the walls within the room and bounce back to the user on the bed 10. These acoustics can create a surround sound effect as heard by the user. The subwoofer 20 can provide for added bass and vibration to be felt by the user of the bed 10.

The bed 10 includes a base 18 having a plurality of rails 32 which are connected to the legs 14. Mounted to or around legs 14 are one or more brackets 30 for holding and securely mounting the speakers 16. The bracket 30, as shown in detail in FIG. 7, includes mating sections having a first piece and a second piece secured together by a plurality of fasteners. In an alternative embodiment, a clamshell construction can be used where fasteners connect two sections that pivot on an opposite end. The bracket 30 is positioned towards the top of the leg 14 to allow the speakers 16 to be spaced away from the floor.

The leg 14 includes an upper end 36 and a lower end 34. The upper end 36 is operable to connect to the base 18 of the bed 10. The lower portion 34 is in contact with the floor. The leg 14 further includes an outer surface 48 which the bracket 30 rests securely against.

The bracket 30 includes a first portion 42 and a second portion 43. The first portion 42 and the second portion 43 are securely interconnected by connectors 44. First portion 42 and second portion 43 wrap around the outer surface 48 of the leg 14. The bracket 30 includes upper support members 46 to prevent a downward slipping of the bracket 30 when mounted to the leg 14. At least one hook 80 is provided to easily and securely mount the speaker 16 to the bracket 30.

In this example, speaker 16 includes an outer surface 50 and a front surface 52 having speaker portions 54, 56.

Figure 7:
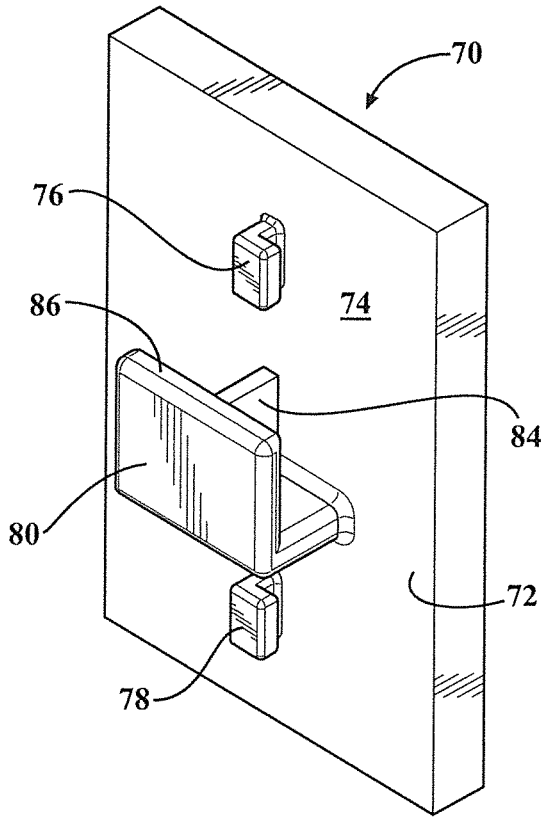
FIG. 7 illustrates a perspective view of a front portion of an alternative example mounting bracket.
Figure 8:
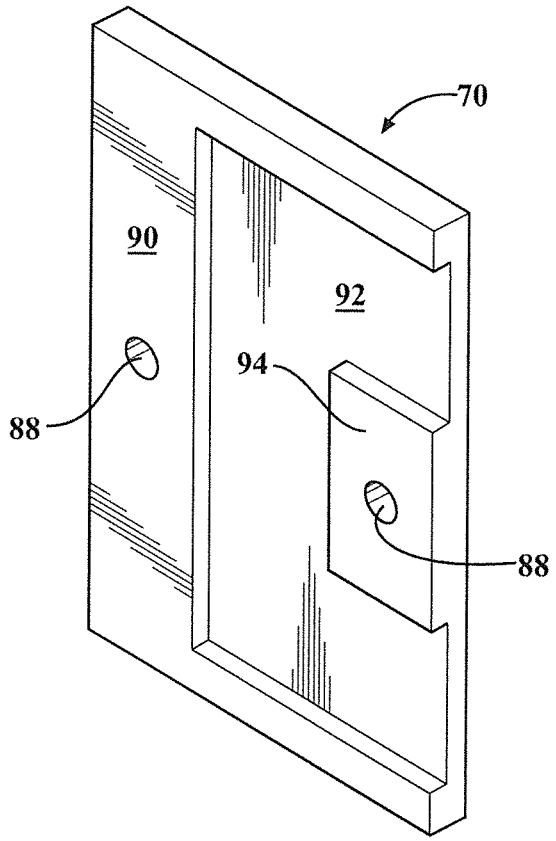
FIG. 8 illustrates a perspective view of a rear portion of the alternative mounting bracket of FIG. 7.
Figure 9:
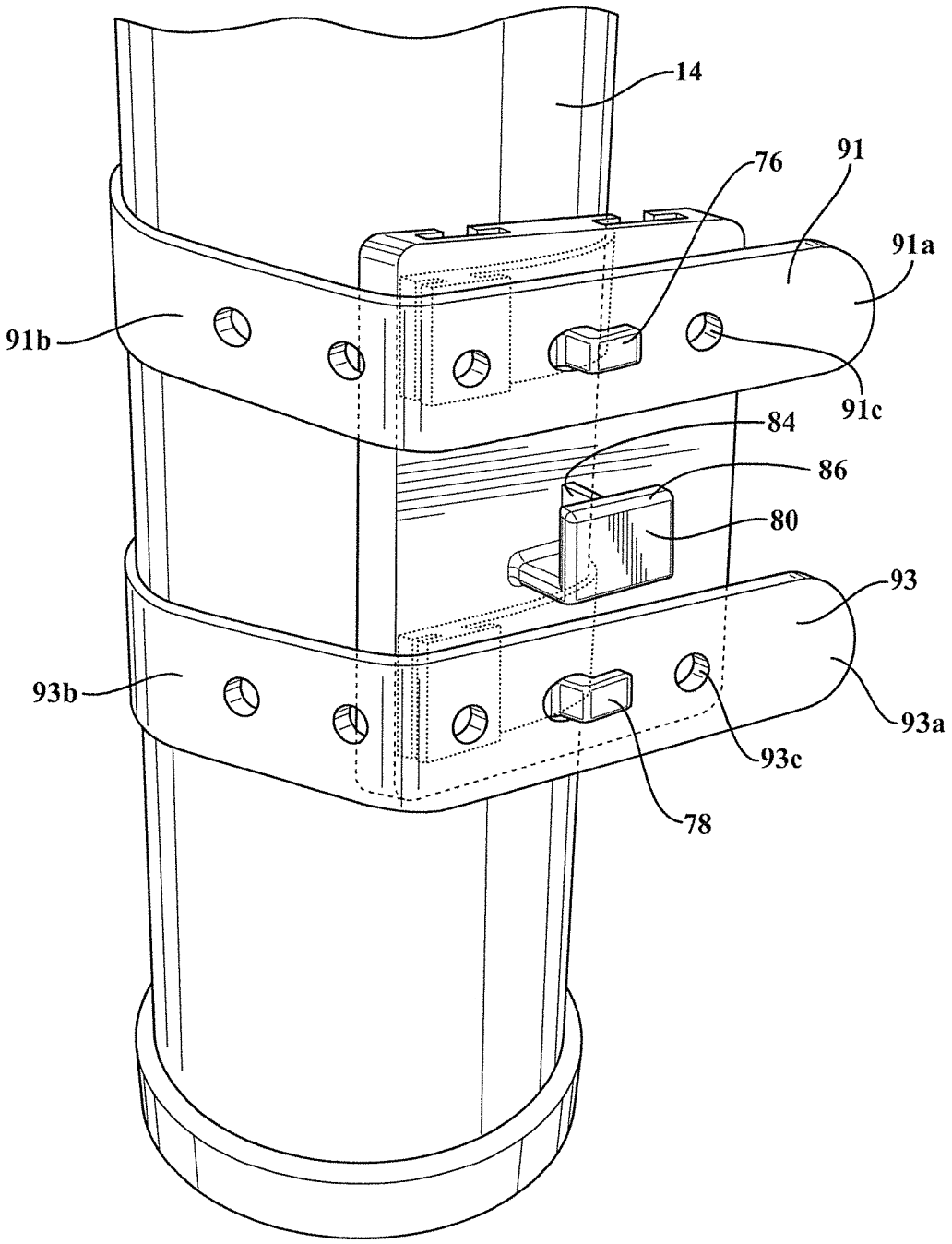
FIG. 9 illustrates a perspective view of the mounting bracket of FIGS. 7 and 8 including a pair of mounting straps.

FIGS. 7-9 illustrate an alternative example mounting bracket for mounting a speaker to a bed or other piece of furniture. The bracket 70 includes a front portion 72 having a first surface 74. In this example, the first surface 74 includes a plurality of hooks 76, 78 for securely connecting a pair of straps 91, 93 to the bracket 70. The straps are operable to wrap around and leg or post of a bed or other piece of furniture. The straps 91, 93 are fully adjustable by having a plurality of apertures provided along the length of the strap. A main hook 80 is provided having a connection to the first surface 74 at reference numeral 80 and a support 84 for further securing the hook 80 and the speaker to the bracket 70. An upper curved surface 86 is provided to accommodate the geometry of the speaker when mounted. The bracket 70 connects to the bed or other piece of furniture by means of at least one strap 91, 93.

FIG. 8 illustrates a rear portion of mounting bracket 73 having a plurality of surfaces 90, 92. The rear portion engages bracket 73 to mount the strap before wrapping around the leg. The front portion 72 and rear portion 73 are configured to interconnect to any bed by means of the straps as illustrated in FIG. 9 thereby providing a speaker support for such a leg. The straps connect to the bracket by means of the hooks 76, 78. The front portion 72 and rear portion 73 are interconnected with fasteners, not shown, that pass through the apertures 88 and 96.

The straps 91, 93, as shown in FIG. 9, each include a respective distal end 91*a*, 93*a*. The straps 91, 93 include respective main body portions 91*b*, 93*b* having a plurality of apertures 91*c*, 93*c*. The apertures 91*c*, 93*c* are adapted to connect with the hooks 76, 68 when in an assembly configuration. The plurality of apertures 91*c*, 93*c* configured to connect to the hooks 76, 78 in an adjustable and universal connection. The straps allow their use to connect the speaker to any shaped leg thereby being a universal mount.

Figure 10:
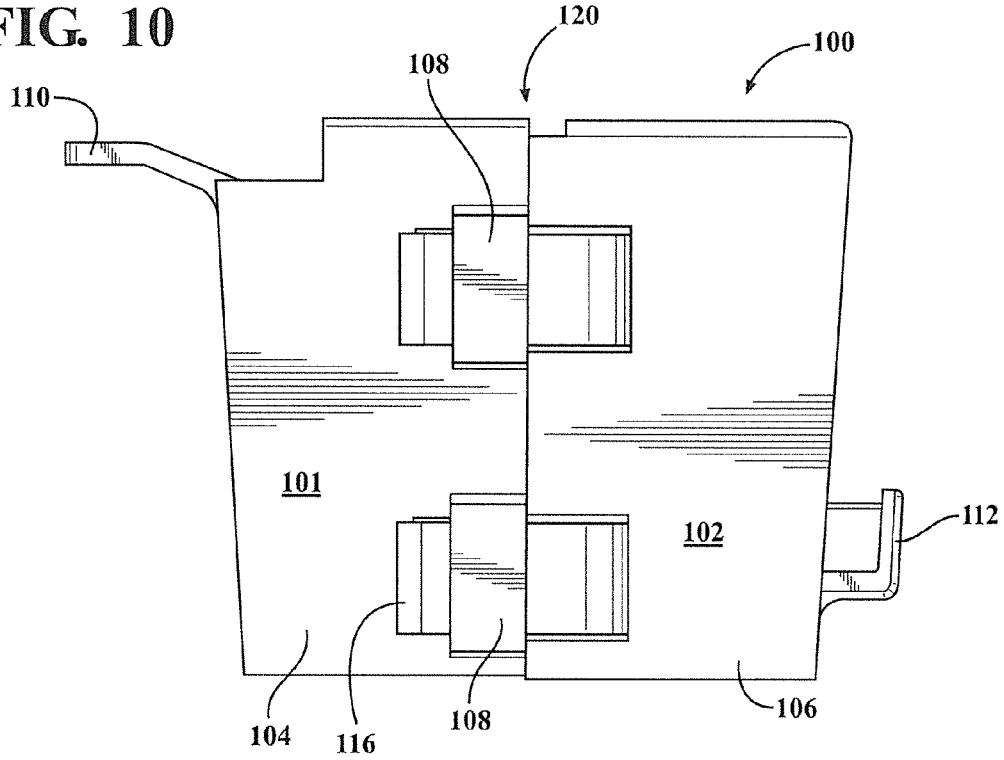
FIG. 10 illustrates a side view of yet another alternative mounting bracket for mounting a speaker to the leg of a piece of furniture.
Figure 11:
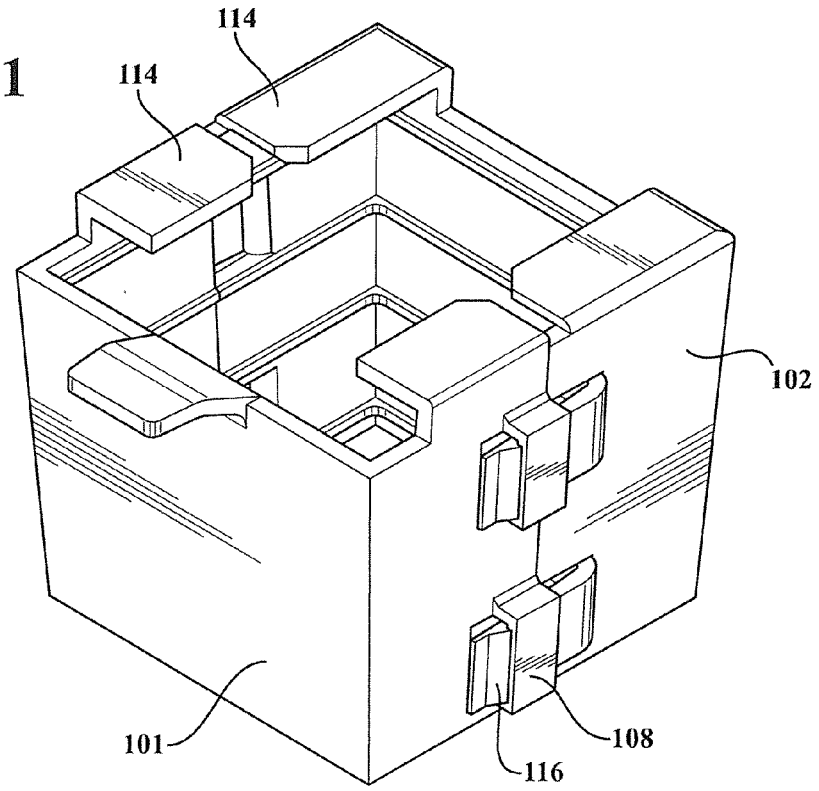
FIG. 11 illustrates a perspective view of the mounting bracket of FIG. 10.

FIG. 10 illustrates yet another alternative mounting bracket 100 for mounting to a different sized and shaped leg of a bed or piece of furniture. The bracket 100 includes a first portion 101 and a second portion 102 arranged in a similar type arrangement such as illustrated in FIG. 7. The first portion 101 and the second portion 102 are securely fastened together by the closures 108. The closure 108 is adapted to connect with a ramped clip portion 116 in a snap fit configuration. A plurality of upper supports 114 are provided to be in contact with an upper portion of the leg connected to the bed or other piece of furniture. One or more mounting hooks 112 are provided to securely mount the speaker to the leg.

In the illustrated embodiments, four speakers are shown, with two speakers positioned on each side of the bed, directed outwardly to the sides. In alternative embodiments, more or fewer speakers may be provided. As one example, a pair of speakers may be provided with one speaker on each side, directed outwardly to the sides. In some embodiments, the speakers are symmetrically disposed with respect to a center line of the bed, and are provided in symmetrical pairs. Some of the speakers may alternatively be directed towards the head or foot of the bed. The position of the speakers may be adjustable for tuning of the surround sound effect.

In the present embodiment, such as illustrated in FIG. 1, the speakers are positioned to direct sound generally orthogonally away from the bed. I alternative embodiments, the speakers are angled at a 45° angle away from the sides of the bed.

Those of skill will recognize that the speakers may be disposed in different positions than shown. In certain embodiments, the outer face of each speaker, where the speaker drivers are located, is disposed inboard of the outer peripheral edge of the bed. In another embodiment, the speaker face lies substantially flush or aligned with the outer peripheral edge of the bed. In other versions the speakers may be closer or farther from the edge of the bed and closer or farther from the floor, or even touching the floor.

Further alternative bracket systems are possible. Additionally, a bed leg may be provided with an integral support for a speaker. As yet another alternative, an integral speaker/leg may be provided which serves both as a support for the bed and the speaker.

Additional subwoofers may be provided, or the subwoofer may be positioned elsewhere in the furniture.

Figure 12:
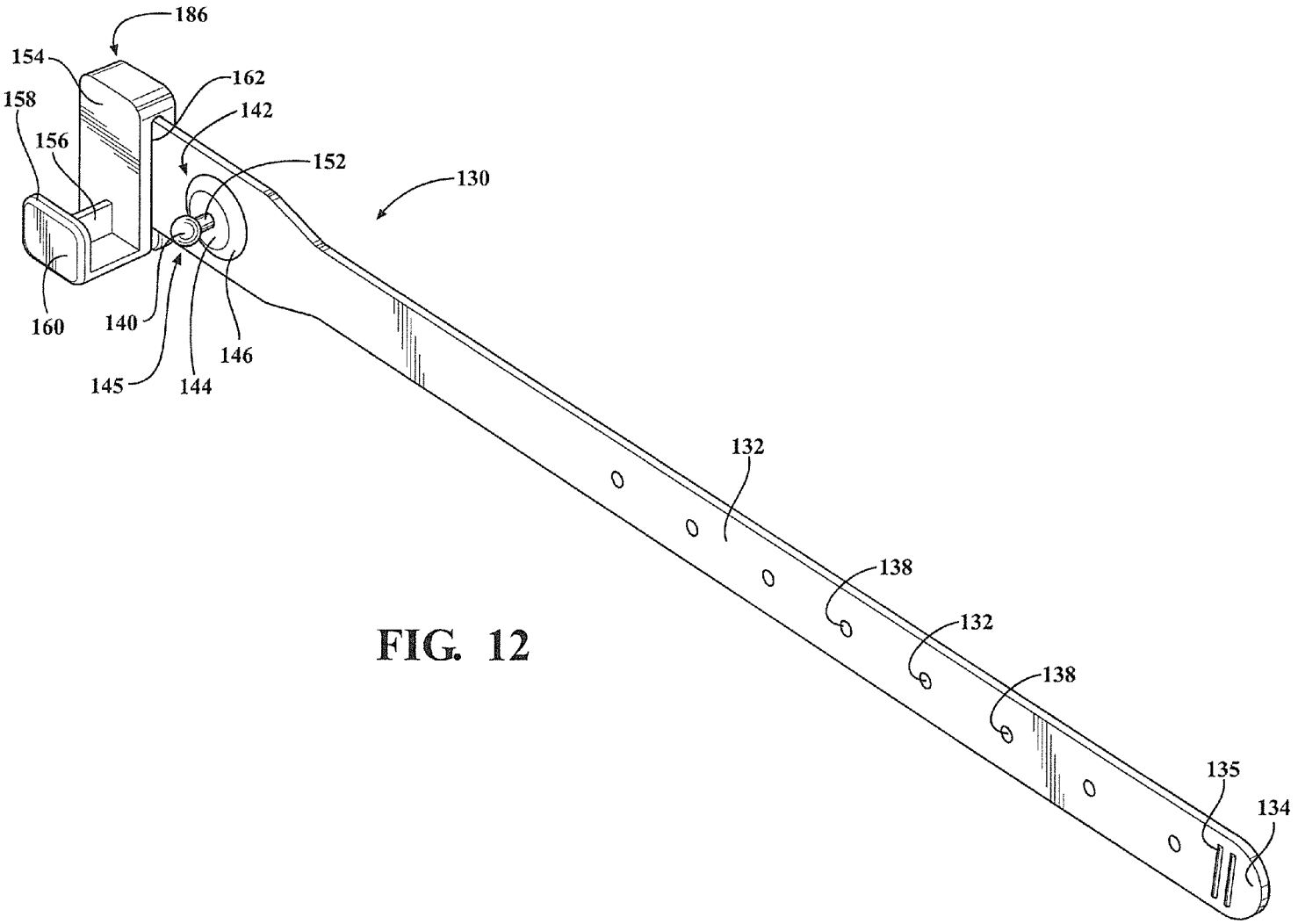
FIG. 12 illustrates a perspective view of a single strap universal mounting bracket embodiment.
Figure 13:
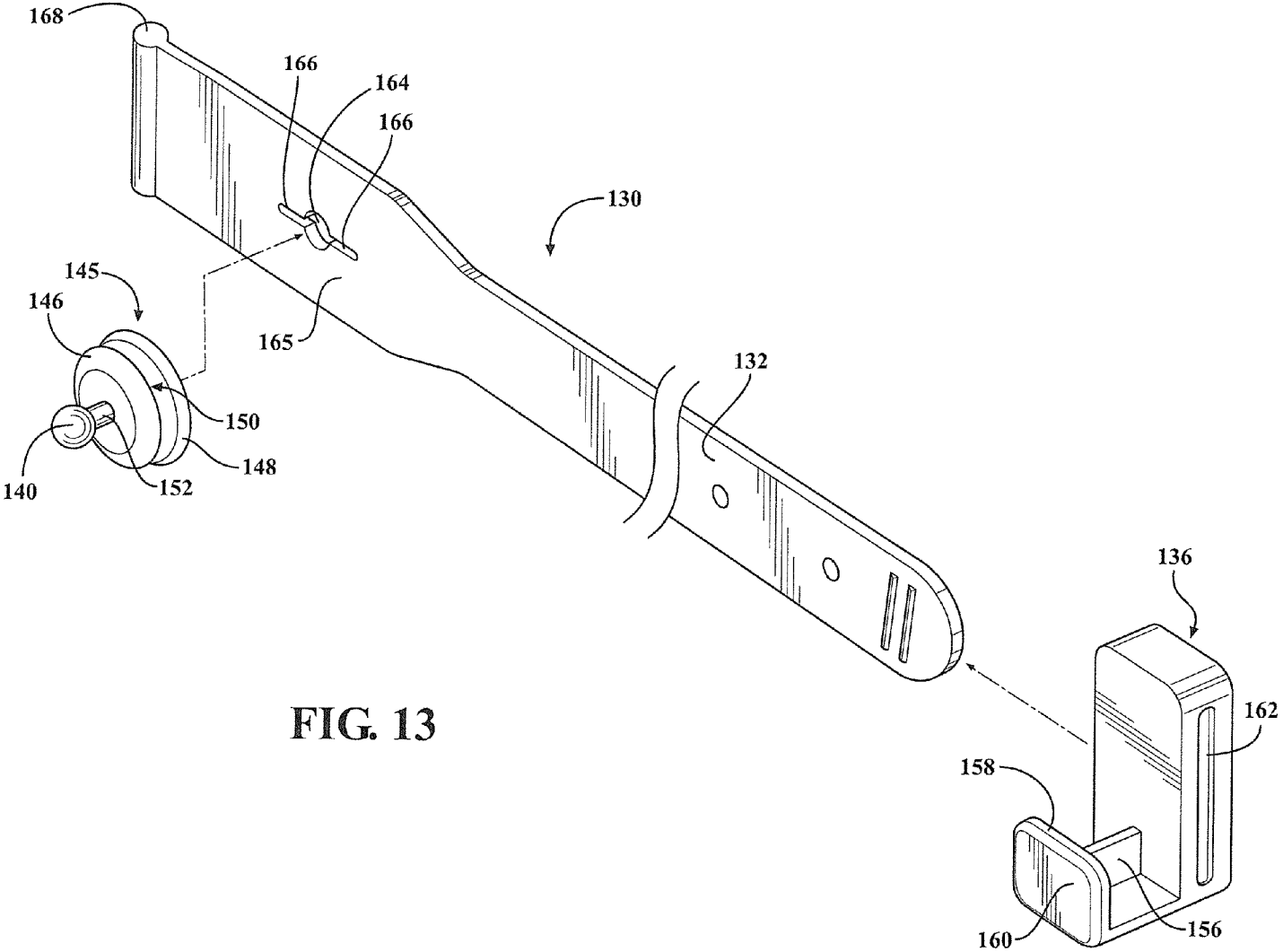
FIG. 13 illustrates a perspective exploded view of the strap of FIG. 12.

FIGS. 12 and 13 illustrate a single strap universal mount for attaching a speaker to a piece of furniture, such as a bed. Strap bracket assembly 130 includes a strap 132 having a distal end 134. The distal end 134 of the strap 132 is adapted to fit and pull partially through an aperture or slot 162 of a bracket 136. Formed in the strap are a plurality of apertures or holes 138 adapted to connect with and secure to the bracket 136 in an assembled configuration. At least one raised tab 135 is provided at the distal end 134.

In this example, the strap 132 is operable to wrap around and leg or post of a bed or other piece of furniture. The strap 132 is fully adjustable by having a plurality of apertures provided along the length of the strap. The strap is adjustable and thus permits connection of the speaker to any shaped leg thereby being a universal mount.

A connector 145 is provided connected to the strap allowing for adjustment and securement of the strap to the leg. The connector 145 includes a bulbous connector 140 adapted to removably and adjustably connect or engage with the apertures 138 of the strap 132. The connector 145 includes a first portion 148 spaced apart from a second portion 144. A slot or groove 150 is formed between the first portion 148 and the second portion 144 and is adapted to receive a portion of the strap 132. The second portion 144 includes a tapered portion 146 to give a flush appearance. A post 152 extends between the connector 140 and the second portion 144.

The strap includes an aperture 164 adapted to receive the connector 145. The connector 145 fits through the aperture 164 be means of the elongated aperture portions 166 (allowing the aperture to stretch to accommodate the connector 145). When in an assembled position, such as shown in FIG. 12, the portion of the strap indicated a reference numeral 165 rests within the slot 150 of the connector 145.

The bracket 136 includes a slot 162 adapted to receive the strap 132. The strap 132 extends through the slot 162 until it reaches the send 168 of the strap 132. End 168 of the strap 132 is larger than the slot 162 to prevent the strap 132 from extending entirely through the slot 162. The bracket 136 further includes a mounting portion for mounting a speaker. The mounting portion includes a hook 162 having a rounded upper edge. A locating feature 165 is also provided to assist in mounting of a speaker.

In an assembled position, the strap 132 wraps around the leg of a piece of furniture. The aperture 138 connects with the connector 140 of the connector 145. After the strap and bracket are in position, a speaker may be installed onto the bracket 136 by means of the hook 160.

Figure 14:
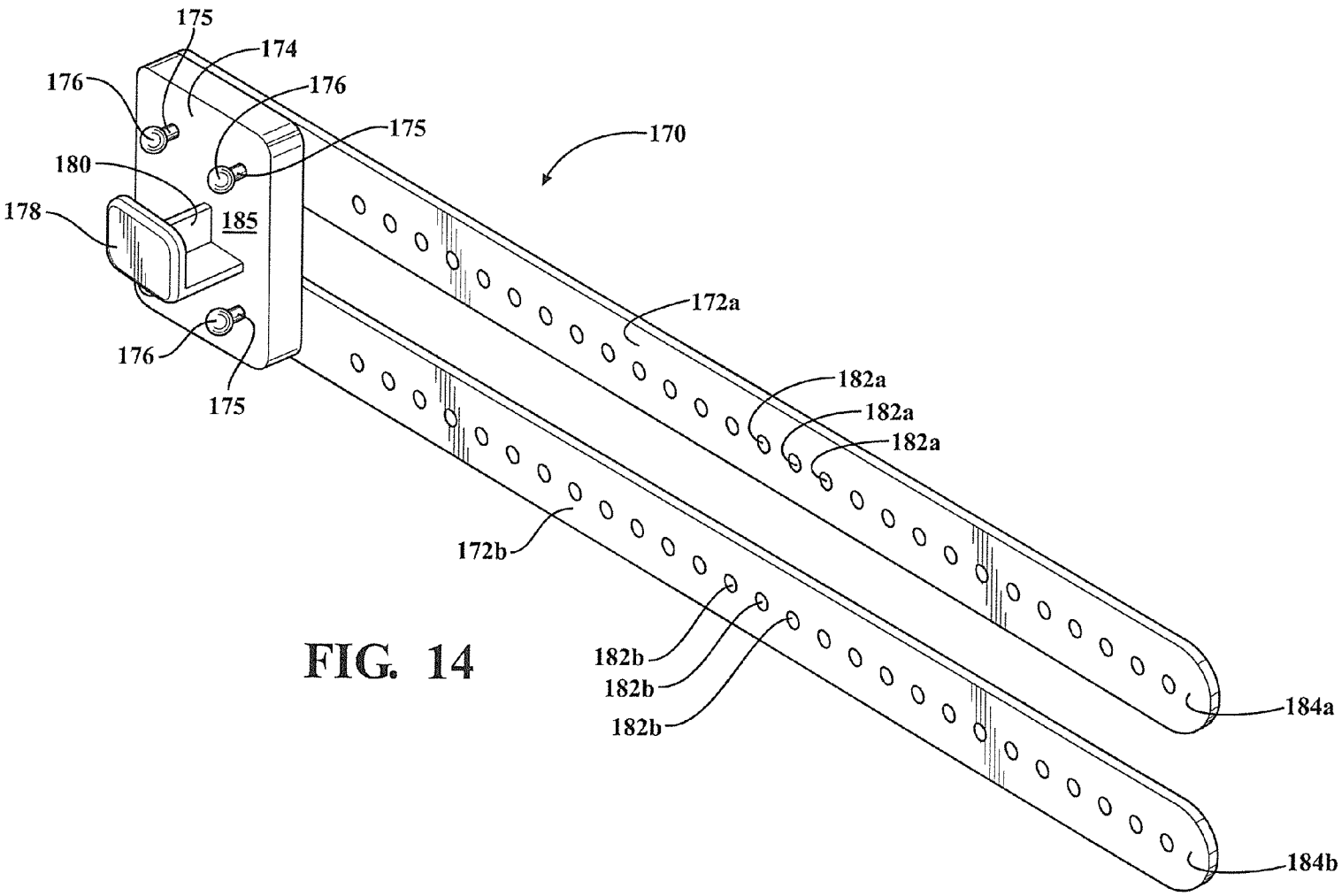
FIG. 14 illustrates a perspective view of an alternative dual strap universal mounting bracket embodiment.

FIG. 14 illustrates an additional embodiment of a dual strap universal mount. The dual strap mount 170 includes a first strap 172*a* and a second strap 172*b*. A mounting bracket 174 is provided connected to the straps 172*a*, 172*b*. The bracket 174 includes a plurality of connectors 176 each having a generally bulbous distal end for connection to a plurality of apertures 182*a*, 182*b*.

The bracket 174 includes the plurality of connectors 176. The connectors connect to a planar surface 185 of the bracket 174. The connectors 176 connect to the bracket 174 by means of a post 175. Each connector 176 is connected to the bracket 174 includes a respective post 175.

The bracket 174 further includes a mounting book 178. The mounting hook is configured to securely mount a speaker to the bracket 174. The mounting hook 178 includes a locator tab 180 for easy connection of the speaker to the bracket 174.

The straps 172*a*, 172*b* each include a plurality of apertures 182*a*, 182*b*. The apertures 182*a*, 182*b* are adapted to connect to the connectors 176 of the mounting bracket 174. Each of the straps 172*a*, 172*b* include respective distal ends 184*a*, 184*b*. When in an assembly position, the straps 172*a*, 172*b* wrap around a leg of a piece of furniture. The apertures 182*a*, 182*b* connect with the connectors 176 on the bracket 174. The bracket 174 is held in an upright position to allow for installation of a speaker.

Figure 15:
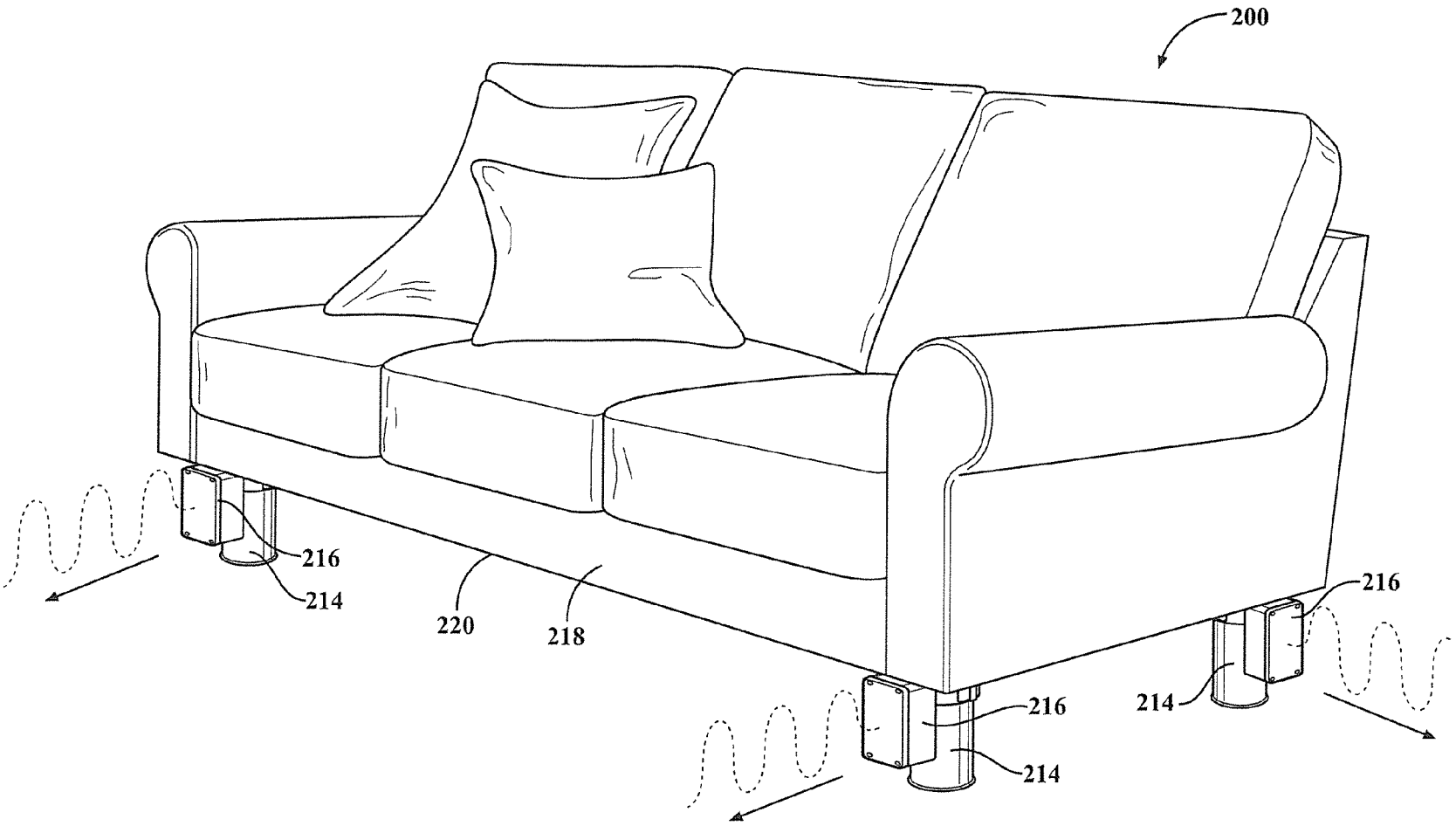
FIG. 15 illustrates a perspective view of a couch having a speaker system of the present disclosure.

FIG. 15 illustrates an alternative embodiment employing the speaker system of the present embodiment on a couch 200. The couch 200 includes a base 218 and a plurality of legs 214. The plurality of legs 214 include the speakers 216 mounted to face outwardly to project sound outwardly from a center portion of the couch 200. An outer peripheral edge 220 is provided on a lower portion of the base 218. The speakers are not visible from the top view and thus mounted inward from the outer peripheral edge 220.

Figure 16:
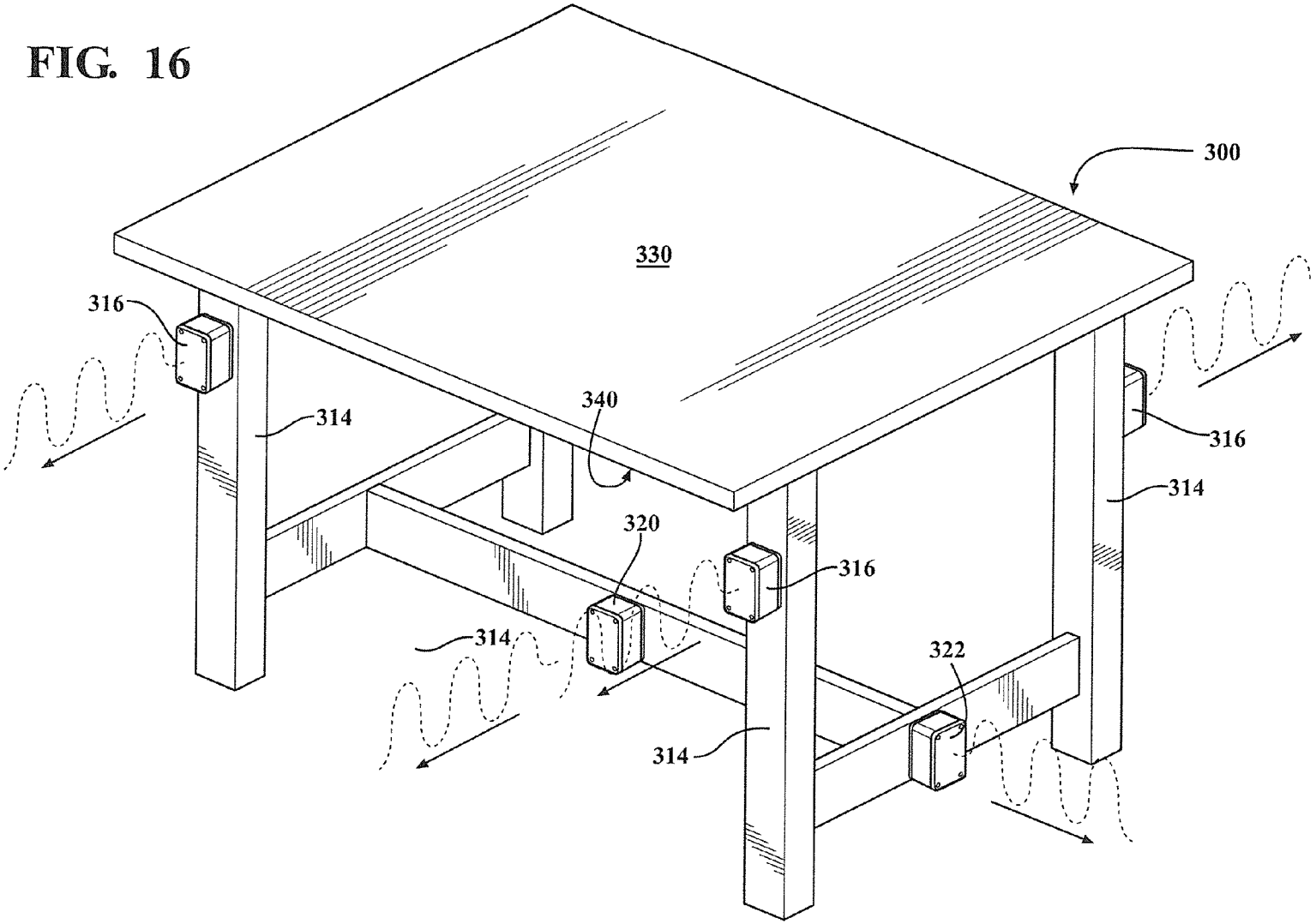
FIG. 16 illustrates a perspective view of a table having a speaker system of the present disclosure.

FIG. 16 illustrates the speaker system of the present invention utilized on a table 300. The table 300 includes a plurality of legs 314 and supports onto which the speakers 316 are mounted to. The table includes an outer peripheral edge 340 disposed on the upper table portion 330 for which the speakers 316 are mounted inwardly from that outer peripheral edge 340. As in the previous embodiments, the speakers 316 are mounted to face outwardly and point away from a center portion of the table 300 to create a surround sound effect as heard by the users sitting at the table. Speakers 320, 322 are also provided on support crossbeams of the table 300.

In alternative embodiments, a noise-canceling feature including a microphone may also be provided mounted to the base of any of the previously discussed embodiments of the present invention. The noise canceling system will include a microphone to pick up noises which the system will at least partially cancel (background traffic, voices, etc.) to create an inverse or opposite sound wave to neutralize the background noise. Such a noise cancelling system will further include processing circuitry, as will be clear to those of skill in the art.

The above speaker configurations can also be sold separately from the bed or other furniture to be installed later by the user in the form of a kit. The kit includes all components necessary to mount a plurality of speaker to the underside of a piece of furniture. The kit may include any of the above mentioned bracket configurations. Instructions may be provided regarding proper installment and positioning of the speakers. Preferably the bracket mounts are universal to fit any bed or other piece of furniture. The kit may be sold as an aftermarket product to be used with any bed or other piece of furniture. Preferably, the kit includes the speakers and the corresponding mounting brackets. However, the kit may also be provided with solely the mounting brackets allowing the user to provide their own speakers.

The present disclosure is not restricted to the illustrative examples and embodiments described above. The embodiments are not intended as limitations on the scope of the invention. Methods, apparatus, compositions, and the like described herein are exemplary and not intended as limitations on the scope of the invention. Changes therein and other uses will occur to those skilled in the art. The scope of the invention is defined by the scope of the claims.

The invention claimed is:

1. A bed having a modular speaker system and a plurality of legs, the bed comprising:

a base having an outer peripheral edge;

a plurality of legs cooperating to support the base;

a plurality of mounting brackets each positioned on an external surface of one of the plurality of legs;

a plurality of modular speakers mounted to and below the base of the bed, each of the plurality of modular speakers mounted to one of the plurality of legs of the bed by one of the plurality of mounting brackets, the plurality of modular speakers each mounted inboard of the outer peripheral edge of the base of the bed such that the plurality of modular speakers are mounted inward from the outer peripheral edge and not visible from a top view of the bed; and the plurality of modular speakers facing away with respect to each other and thereby simulating a surround sound.

2. The bed of claim 1, wherein each mounting bracket is mounted to the one of the plurality of legs by at least one strap.

3. The bed of claim 2, wherein each bracket includes a support feature for anchoring one end of the strap.

4. The bed of claim 1, wherein the modular speaker system further includes a subwoofer mounted to the base.

5. The bed of claim 1, wherein the speaker system further includes a noise cancellation system having a microphone.

6. The bed of claim 1, wherein the mounting bracket has an L-shaped mounting feature.

7. The bed of claim 6, wherein the mounting bracket is adapted to be connected to a flexible strap and includes a slot for receiving the flexible strap.

8. A speaker system operable to mount to a bed, the bed having a plurality of legs and a base having an outer peripheral edge, the speaker system comprising:

at least one speaker configured to be mounted to at least one leg of the bed, the speaker mounted to an external surface on the at least one leg and inboard of the outer peripheral edge of the base of the bed such that the at least one speaker is mounted inward from the outer peripheral edge and not visible from a top view of the bed;

a mounting bracket formed to mount to a leg of the bed and having at least one mounting feature for supporting the at least one speaker;

wherein the speaker is mounted to the mounting bracket by way of the at least one mounting feature.

9. The speaker system of claim 8, wherein the mounting bracket includes at least one fastener adapted to securely mount to the leg below the base and above a floor.

10. The speaker system of claim 8, wherein the mounting bracket includes at least one mounting strap adapted to wrap around the leg to securely mount the mounting bracket below the base and above a floor.

11. The speaker system of claim 10, wherein the at least one mounting strap includes a plurality of apertures to receive a securing feature formed on the mounting bracket to accommodate and mount to variously shaped and sized furniture legs.

12. The speaker system of claim 11, further including a subwoofer.

13. The speaker system of claim 8, wherein the bed is an adjustable bed, the speaker system further having a power supply integrated with a power supply of the adjustable bed.

14. The speaker system of claim 13, wherein a wireless device or remote control is operable to control both the adjustable bed and a wireless communication module.

15. The speaker system of claim 14, wherein the wireless communication module is operable to communicate via Wi-Fi or Bluetooth.

16. A combination of a speaker and a speaker mounting assembly for attaching the speaker to a bed, the combination comprising:

a speaker; and a speaker mounting assembly, including:

at least one flexible strap, the at least one strap having a free end;

an L-shaped bracket having a back portion with a slot therein, a bottom portion extending outward from the back portion, and a hook portion extending up from the bottom portion, the bracket adapted to connect to the flexible strap directly, the speaker directly mounting on the hook portion of the L-shaped bracket; and a connector mounted to either the bracket or the strap, the connector having a projection configured to secure the free end of the flexible strap when in an assembled position.

17. The combination of claim 16, wherein the flexible strap, the bracket and the connector are each separate components.

18. The combination of claim 16, wherein the flexible strap includes an aperture adapted to hold and secure the connector.

19. The combination of claim 16, wherein the flexible strap includes a plurality of apertures and the connector includes a general bulbous distal end adapted to securely connect with one of the plurality of apertures of the flexible strap.

20. The combination of claim 16, wherein the bracket includes an aperture configured to secure the strap to the bracket thereby allowing the flexible strap to wrap around a portion of the bed.

21. The combination of claim 16, wherein the strap is wrapped around and connected to the connector at a location away from the bracket.

* * * * *